US006199217B1

(12) United States Patent
Mooney

(10) Patent No.: US 6,199,217 B1
(45) Date of Patent: Mar. 13, 2001

(54) PROTECTIVE LEG SOCK

(76) Inventor: Charles E. Mooney, 2838 Washington Ave., St. Albans, WV (US) 25177

( * ) Notice: Subject to any disclaimer, the term of this patent is extended or adjusted under 35 U.S.C. 154(b) by 0 days.

(21) Appl. No.: 09/447,066

(22) Filed: Nov. 22, 1999

(51) Int. Cl.[7] ..... A43B 17/00
(52) U.S. Cl. ..... 2/240
(58) Field of Search ..... 2/240, 239, 241, 2/242, 22, 23, 61, DIG. 1; 36/10, 2 R; D2/860, 909

(56) References Cited

U.S. PATENT DOCUMENTS

| | | | | |
|---|---|---|---|---|
| D. 400,338 | * | 11/1998 | Maves | D2/860 |
| D. 414,018 | * | 9/1999 | Cook | D2/910 |
| 529,352 | * | 11/1894 | Bailey | 36/2 R |
| 825,851 | * | 7/1906 | MacKaskie | 2/DIG. 1 |
| 1,621,153 | * | 3/1927 | Bunnenberg | 36/2 |
| 2,125,451 | * | 8/1938 | Kolliner | 36/2 |
| 2,304,177 | * | 12/1942 | Jones | 36/2 |
| 2,343,477 | * | 3/1944 | Ross | 36/10 |
| 2,406,090 | * | 8/1946 | Mas | 36/2 |
| 3,128,565 | * | 4/1964 | Graham et al. | 36/2 |
| 4,461,098 | * | 7/1984 | Diegelman | 36/2 R |
| 4,542,597 | * | 9/1985 | Baptista et al. | 36/2 R |
| 4,809,447 | * | 3/1989 | Pacanowsky et al. | 36/9 R |
| 4,856,207 | * | 8/1989 | Datson | 36/2 R |
| 4,964,176 | * | 10/1990 | Previdi | 2/242 |
| 5,005,215 | | 4/1991 | McIlquham . | |
| 5,010,597 | * | 4/1991 | Glover | 2/242 |
| 5,031,247 | | 7/1991 | Carter . | |
| 5,170,503 | | 12/1992 | Hightower et al. . | |
| 5,173,967 | | 12/1992 | Carter . | |
| 5,566,396 | * | 10/1996 | Leib | 2/239 |
| 5,570,470 | | 11/1996 | Miller . | |
| 5,613,250 | * | 3/1997 | Bell | 2/242 |
| 5,692,932 | * | 12/1997 | Lance et al. | 441/60 |
| 5,697,106 | * | 12/1997 | Baker et al. | 2/239 |
| 5,814,003 | * | 9/1998 | Knox et al. | 602/63 |
| 5,815,948 | * | 10/1998 | Dzielak | 36/2 R |
| 5,896,676 | * | 4/1999 | Barousse | 36/2 R |
| 5,970,525 | * | 10/1999 | Galliont et al. | 2/242 |

* cited by examiner

*Primary Examiner*—John J. Calvert
*Assistant Examiner*—Alissa L. Hoey
(74) *Attorney, Agent, or Firm*—Henderson & Sturm LLP

(57) ABSTRACT

A protective leg sock suitable for use when operating a flexible line weed trimmer. The sock includes a tubular leg enclosing portion that has an upper open end that pulls up to just above the knee, and a lower open end that flares out to cover the front top portion and the rear heel portion of the user's shoe. An elastic ring encircles the tube above the lower open end to engage the ankle area and prevent material from entering from the bottom. A cord and spring biased barrel closure secures the tube to the leg just above the knee, and grommets on each side of the tube below the upper end provide ventilation. The sock is preferably made from four mil, diamond embossed, tubular plastic film stock.

5 Claims, 1 Drawing Sheet

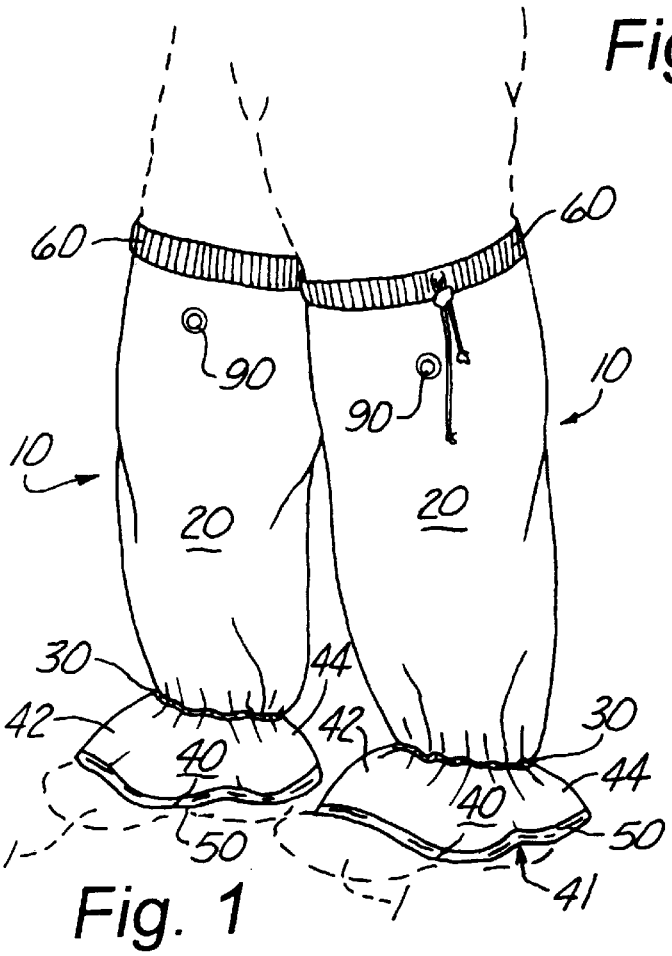
Fig. 1
Fig. 2
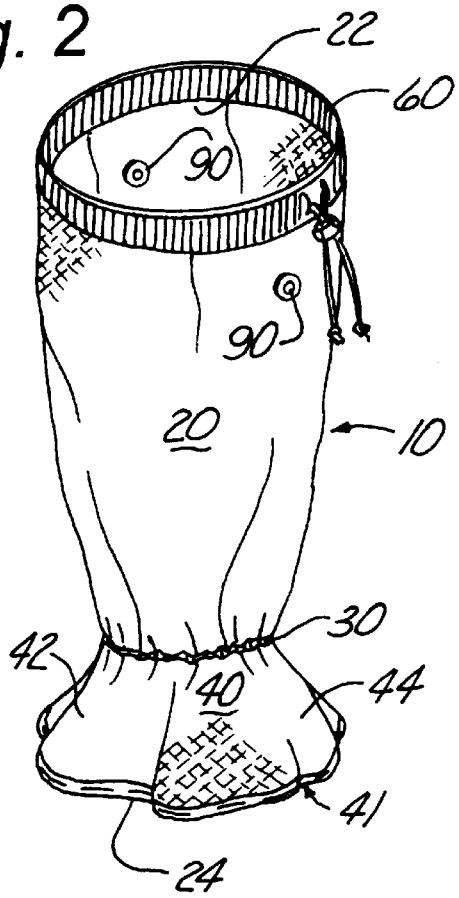
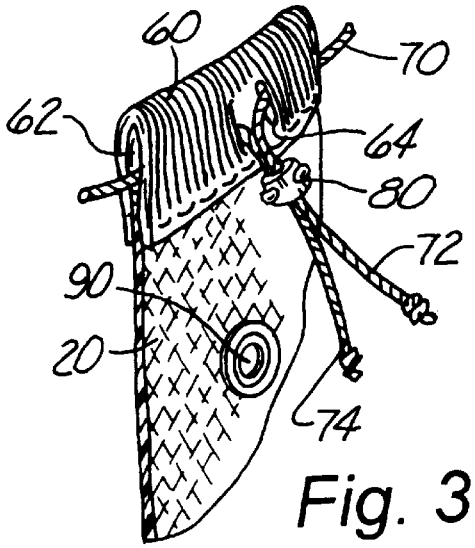
Fig. 3

PROTECTIVE LEG SOCK

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

This invention relates to the field of protective clothing, and more particularly to a protective leg sock.

2. Description of the Related Art

As can be seen by reference to the following U.S. Pat. Nos. 5,005,215; 5,031,247; 5,170,503; 5,173,967; and 5,570,470, the prior art is replete with myriad and diverse protective leg coverings.

While all of the aforementioned prior art constructions are more than adequate for the basic purpose and function for which they have been specifically designed, they are uniformly deficient with respect to their failure to provide a simple, efficient and practical protective leg sock suitable for use when operating a flexible line weed trimmer, such as a "WEEDEATER" trimmer. When using a weed trimmer, there are two final results: a neatly trimmed yard; and legs and shoes that are completely covered with grass, weeds, some poisonous oils, dust and dirt.

This not only ruins the operator's jeans, socks and shoes, but numerous people wear shorts while using a weed trimmer and contract problems with poison ivy, poison oak and other allergies associated with weeds and pollen. Just trying to brush off or clean up clothing or untying shoes are very easy ways to become contaminated.

As a consequence of the foregoing situation, there has existed a longstanding need for a new and improved protective leg sock and the provision of such a construction is a stated objective of the present invention.

BRIEF SUMMARY OF THE INVENTION

Briefly stated, the present invention provides a protective leg sock suitable for use when operating a flexible line weed trimmer. The sock includes a tubular leg enclosing portion that has an upper open end that pulls up to just above the knee, and a lower open end that flares out to cover the front top portion and the rear heel portion of the user's shoe. An elastic ring encircles the tube above the lower open end to engage the ankle area and prevent material from entering from the bottom. A cord and spring biased barrel closure secures the tube to the leg just above the knee, and grommets on each side of the tube below the upper end provide ventilation. The sock is preferably made from four mil, diamond embossed, tubular plastic film stock.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein:

FIG. 1 is a perspective view of a pair of protective leg socks of the present invention being worn by an individual;

FIG. 2 is a perspective view of a single sock illustrating the diamond embossed surface texture; and FIG. 3 is a partial perspective sectional view showing the top cuff with an internally disposed cord, and a spring-biased barrel closure used to secure the upper end of the sock to the user's leg just above the knee.

DETAILED DESCRIPTION OF THE INVENTION

As can be seen by reference to the drawings, and in particular to FIG. 2, the protective leg sock that forms the basis of the present invention is designated generally by the reference number 10. The sock 10 includes a tubular leg enclosing portion 20 with an upper open end 22 and a bottom open end 24. An elastic ring 30 encircles the tube 20 above the bottom end 24 in the area of the user's ankle. A shroud 40 flares out downwardly from the ring 30 where a front section 42 covers the front top of the user's shoe 1 and a rear section 44 covers the top heel portion of the shoe 1. The bottom end 24 is reinforced by attaching a ring of bias tape 50.

As best shown in FIG. 3, the upper open end 22 carries a cuff 60 that is folded over to form a tunnel 62 that receives a cord 70. The free ends 72, 74 of the cord 70 extend out of the tunnel 62 through slits 64 and are engaged by a spring-biased barrel closure 80. The closure 80 is selectively moved along the cord 70 to adjust the length of cord 70 within the tunnel 62 to secure the upper end 22 to the leg of the user just above the knee. Grommets 90 on each side of the sock 10 provide ventilation.

The socks 10 are a cover-up that go over the shoe and pull up to just above the knee and are tightened by a barrel closure 80 that is attached to an elastic cord 70. The shroud 40 is designed to cover ⅔ of the shoe 1. The elastic ring 30 allows the socks 10 to fit all sizes and allows the socks 10 to pull up tight around the ankle to keep anything from entering the sock 10. Two grommets 90 are placed at the top of the sock 10 near the cuff 60 to allow the sock 10 to breathe.

The sock 10 is not meant to be a safety protector from the speed of the string of the trimmer. The design is solely to keep the user clean and uncontaminated.

The sock 10 is simple in design and may be manufactured using the procedure which follows. The preferred material of construction is a four mil diamond embossed plastic film since this material will not allow grass to stick very well. This material is available in a twelve and one-half inch (12½") tube which gives it a twenty-five inch (25") circumference. The tubular film is cut to a length of twenty-five inches (25"), and a notch pattern 41 for the shoe shroud 40 is cut at the bottom. The next step is to install bias tape 50 around the bottom 24 and sew a piece of one-half inch (½") wide elastic 30 five inches (5") up from the bottom 24 of the sock 10. A half-inch (½") grommet 90 is then installed in the middle of the sock 10 and on both sides and located three inches (3") down from the top 22 of the finished sock 10. This grommet 90 is installed for a vent to allow warm air to vent out. The next step is to install a cuff 60 at the top 22. The cuff 60 starts with a piece of material, such as that used for cuffs on jackets, that is three inches ("'3") wide and twenty-five inches (25") long. The material is folded over to create a tunnel 62 inside. The cuff 60 is one and one-half inches (1½") wide when sewn to the top 22. A one eighth inch (⅛") diameter elastic cord 70 twenty-nine inches (29") long is installed into the tunnel 62 of the cuff 60. Finally, a spring loaded barrel closure 80 is installed onto the elastic cord 70 which allows tightening of the cuff 60 as desired, holding it securely to the leg.

The sock 10 will go over a man's size 15 shoe and probably larger depending on type of shoe. If shoes are much larger, the user may want to remove the shoe, put on the socks 10 and then put the shoe back on.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

I claim:

1. A protective leg sock for a human leg, consisting of: a generally tubular leg enclosing portion fabricated from tubular plastic film and having an upper open end, a lower open end; and a cuff adapted to encircle the open upper end, the cuff including a closed tunnel and a slit communicating between a point interior of the tunnel and a point exterior of the tunnel an elastic ring attached to encircle the leg enclosing portion at a location vertically spaced up from the lower open end;

a shroud section extending down from the elastic ring to the open lower open end, the shroud section being disposed to flare downwardly out from the elastic ring and including a front section disposed to cover a front top portion of a user's shoe, and a rear section disposed to cover a top heel portion of the user's shoe;

a cord having free ends attached to encircle the leg enclosing portion at the upper open end, the cord being disposed to extend through the tunnel with the free ends disposed to extend through the slit exterior of the tunnel;

a spring-biased barrel closure attached to the cord near the free ends, whereby a length of the cord within the tunnel is selectively adjustable; and, a pair of opposed ventilation openings formed through the leg enclosing portion at a location proximate to, but spaced from, the upper open end of the leg enclosing portion.

2. The protective leg sock as in claim 1; wherein said cord is elastic.

3. The protective leg sock as in claim 2; wherein said ventilation openings comprise ½ inch grommets.

4. The protective leg sock of claim 3 wherein the plastic film has a four mil thickness.

5. The protective leg sock of claim 4, wherein the plastic film is diamond embossed.

* * * * *